US005843005A

United States Patent [19]

Chubinsky

[11] Patent Number: 5,843,005

[45] Date of Patent: Dec. 1, 1998

[54] DEVICE FOR DEEP TISSUE MASSAGE AND IONIC THERAPY

[76] Inventor: Vladimir Chubinsky, 3462 Drayton Dr., Roswell, Ga. 30075

[21] Appl. No.: 729,682

[22] Filed: Oct. 4, 1996

[51] Int. Cl.[6] ..... A61H 7/00

[52] U.S. Cl. ..... 601/15; 601/135; 601/137; 601/138

[58] Field of Search ..... 601/15, 134, 8

[56] References Cited

U.S. PATENT DOCUMENTS

| | | | |
|---|---|---|---|
| D. 285,116 | 8/1986 | Hoff | D24/36 |
| D. 326,722 | 6/1992 | Sue | D24/214 |
| 1,026,481 | 5/1912 | Ward | 601/135 |
| 2,017,400 | 10/1935 | Hoyer | 601/135 |
| 4,022,189 | 5/1977 | Boxer | 128/1 |
| 4,033,054 | 7/1977 | Fukuoka | 36/11.5 |
| 4,126,129 | 11/1978 | Rainbow | 128/67 |
| 4,508,119 | 4/1985 | Tukamoto | 128/329 |
| 4,798,194 | 1/1989 | Amishima | 128/9 |
| 5,195,510 | 3/1993 | Svacina | 128/61 |
| 5,382,222 | 1/1995 | Yih-Jong | 601/135 |
| 5,416,936 | 5/1995 | Chan | 5/448 |
| 5,624,384 | 4/1997 | Chen | 601/135 X |
| 5,624,385 | 4/1997 | Hwang | 601/135 |

FOREIGN PATENT DOCUMENTS

| | | | |
|---|---|---|---|
| 467451 | 6/1914 | France | 601/135 |
| 2 606 633 | 5/1988 | France . | |
| 349399 | 9/1972 | U.S.S.R. | 601/15 |
| 349399 | 10/1972 | U.S.S.R. . | |
| 1456150-A | 2/1989 | U.S.S.R. . | |

OTHER PUBLICATIONS

Brochure, The Knobble Whole–body Massage Tool, Knobble Assoc. (1992).

Brochure, Using Your Index Knobber II, Pressure Positive Co. (1996).

Catalog, Body Tools (undated).

Point of Sale Label, Soother Massage Tool, Body Tools (undated).

Brochure, NordicTrack Happy Heart Massage Tool, Thompson Family Ent. (1996).

V.P. Zotov, Sport Massage, Zdorovia, Kiev, Ukraine (1987).

Alternative Medicine *A Guide to Natural Therapies*, Dr. Andrew Stanway (1979).

*Your Complete Guide to Medical Magnets Nature's Healing Energy*, Barbara Gordon (1991).

"Body Tools" website from Internet: http://bodytools.com/btmass2.htm (Jul. 1, 1997).

Brochure, The Original Jacknobber II, Presure Positive Co. (1996).

*Primary Examiner*—Danton D. DeMille

*Attorney, Agent, or Firm*—Needle & Rosenberg, P.C.

[57] ABSTRACT

This invention comprises a hand held device for deep tissue massage and/or for augmenting lymphatic drainage which also utilizes negative ionic therapy, having a tool part with a head end of a preselected shape that is removably attached to a handle part. The handle part has an ergonomic, substantially oval shape of a predetermined diameter and thickness. The device further has a negative ion emitting surface covering at least a portion of the tool part or the handle part. A method of deep tissue massage and negative ionic therapy is also provided.

1 Claim, 5 Drawing Sheets

DEVICE FOR DEEP TISSUE MASSAGE AND IONIC THERAPY

FIELD OF THE INVENTION

This invention relates to an ergonomically shaped device and method for deep tissue massage and/or augmenting lymphatic drainage which utilizes negative ionic energy.

BACKGROUND OF THE INVENTION

The art of massage has been practiced for many hundreds of years by lay persons and physical therapists alike. The expense of hiring a professional masseuse has led to the development of "do it yourself" massage devices. Hand held devices such as U.S. Pat. No. Des. 285,116, U.S. Pat. No. Des. 326,722, U.S. Pat. No. 4,126,129 and FR 2606-633-A have even been designed to facilitate self-massage. Designs such as the rolling massaging mattress, U.S. Pat. No. 5,416,936, the footwear massager, U.S. Pat. No. 4,033,054 or U.S. Pat. No. 5,382,222 have likewise been designed for self-massage. These devices, in general are designed for use the lay person without regard for the comfort or safety of the professional therapist.

Wood is a popular material among designers of massage devices as can be seen with U.S. Pat. No. 5,195,510 or the commercial embodiment of the aforementioned Des. 285,116, known as the Knobble®. Wood has the disadvantage of adsorbing bodily fluids thereby transmitting germs or disease from one individual to the next and is therefore unsuitable for use by the professional therapist.

The professional massage therapist must endure many hours of repeated physical exertion of the hands and forearms and treat many different patients and different areas of the body. Thus there is a need for an ergonomically designed device which fits comfortably in the hand of the massage therapist which can be utilized repeatedly and can effectively utilized to treat the many different conditions encountered by the professional.

The benefits of negative ionic energy therapy are known. NASA has used negative ionizers to enhance the atmosphere in spacecraft. Negative air ionizers have also been used to reduce heart rate and in the therapy of high blood pressure. as well as to reverse the effects of harmful positive ions and to affect endocrine secretion (See e.g., *Alternative Medicine*,, by Dr. Andrew Stanway (1979)).

Russian doctors, and physical therapists have known the value of negative ionic therapy for some time. The device described in Russian patent SU 000349399 A utilizes a pre-charged disc having a flat polished working surface which is held 1–2 cm above a patient for delivery of negative ions. The device is utilized on dry skin with no application of pressure during therapy. SU 1456-150-A is a cumbersome roller device utilizing rollers constructed of a dielectric material.

Russian therapists have also utilized a pointed carrot shaped device for pinpoint delivery of ionic energy in conjunction with segmental massage (See. V. P. Zotov, Sport Massage (a Russian Sports Massage book) published by Zdorovia, Keiv, Ukraine (1987).

Prior to the present invention, however, there has not been a device designed for the professional which combines the use of negative ionic therapy with deep tissue massage. Likewise there is a need for such a single device which is ergonomically adapted for repeated utilization by the professional therapist and which is capable of utilization over a wide range of applications.

OBJECTS OF THE INVENTION

It is an object of the invention to provide a hand held ergonomic device which delivers negative ions directly into the body through physical therapy and massage techniques.

It is further an object of the invention to provide a hand held device that is comfortable for the user and which can be repeatedly used by the professional massage therapist without fatiguing or damaging the therapists hands and forearms.

Another object of the invention is to provide an ergonomic device which can be utilized to facilitate lymphatic drainage and also provide negative ionic therapy.

Yet another object of the invention is to provide an ergonomically designed massage tool and negative ionic therapy device which has interchangeable tool heads for use in more than a single type of massage therapy.

It is an object of the invention to provide a method of deep tissue massage, and a method of facilitating lymphatic drainage which also simultaneously utilizes negative ionic therapy for increased patient benefit.

SUMMARY OF THE INVENTION

The present invention provides a device for deep tissue massage and or/ for facilitating lymphatic drainage which also provides negative ionic therapy. In a preferred embodiment, the device is comprised of a handle part and a removable tool part. The tool part has a head end of a preselected shape an intermediate shaft and a tail end that projects a predetermined distance from the head end terminating in a means for removable attachment to the handle part. The handle part is ergonomically shaped having a substantially oval shape of a predetermined diameter and thickness and may be utilized with a variety of differently shaped tool parts. The handle part has a top and a bottom surface, with means for removably receiving the tail end of the tool part adjacent the top surface. In particular, the device is comprised of a negative ion emitting surface that covers at least a portion of the tool part or the handle part.

In a preferred embodiment, the negative ion emitting surface is comprised of a medical ebonite (hard rubber), amber, or a suitable plastic or polymer. In the preferred embodiment, the medical grade ebonite has a sulphur content of greater than about 20 percent but especially greater than about 30 percent.

The invention also provides, one embodiment wherein the device for deep tissue massage and negative ionic therapy, comprises first and second handle parts, each having an ergonomic, substantially oval shape of a predetermined diameter and thickness. Each handle part has an inner surface and an outer surface with means adjacent each inner surface for removable attachment to a connecting shaft. The connecting shaft has a preselected length and a first end and a second end, with each end terminating in means complimentary to the receiving means for removable attachment of the first and second handle parts. A negative ion emitting surface comprises at least a portion of a selected surface of the first or second handle parts. In a preferred embodiment, the negative ion emitting surface is comprised of a medical grade ebonite having a sulphur content of greater than about 20 percent, but especially greater than about 30 percent.

Also provided by the invention is a device for deep tissue massage and negative ionic therapy which is comprised of a substantially conically shaped member having an inner surface which forms a hollow concave cavity that is open at a proximal end and an outer surface. The hollow cavity is adapted for insertion of at least a portion of a digit for providing a finger tip massage. At least a portion of the outer surface is comprised of a negative ion emitting material. The negative ion emitting surface can be comprised of a medical grade ebonite having a sulphur content of greater than about 20 percent, but especially greater than about 30 percent.

The invention further provides a method of deep tissue massage which delivers negative ionic therapy to a target area of a patient's body. In one embodiment the method comprises placing a hand held massage device that has a negative ion emitting surface on the target area and moving the device in a preselected direction while applying a predetermined amount of pressure, thereby providing massage and negative ions to the target area. In particular, the movement and pressure application can provide cross fiber friction for treatment of tendinitis, utilize meridians of the body for relaxation, facilitate lymphatic drainage of the target area or provide segmental massage to treat disorders of the spine and associated musculature.

DETAILED DESCRIPTION OF THE INVENTION

Depending upon the context where used, "a" can mean one or more than one.

Figure 1:
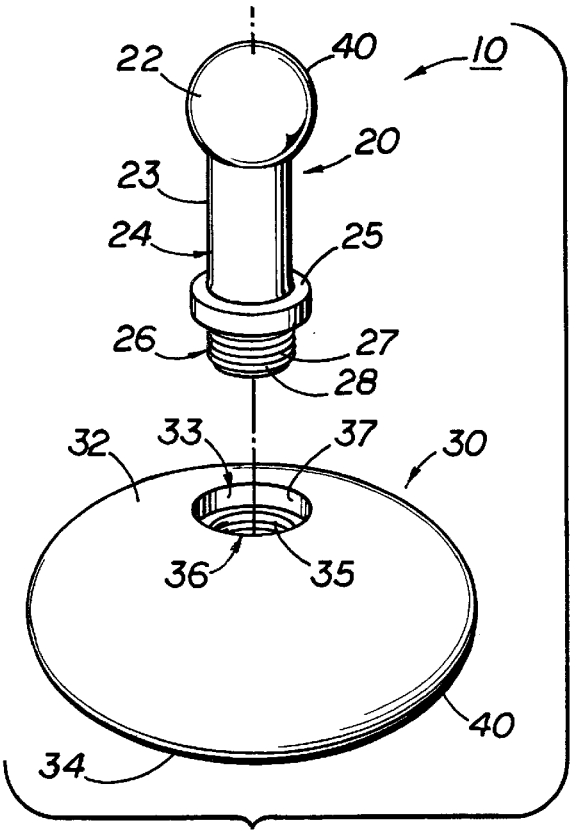
FIG. 1 shows an exploded perspective view of one embodiment of the device made according to the invention.

FIG. 1 shows one highly desirable embodiment of this invention, which is an ergonomically shaped, hand-held device 10 for deep tissue massage and negative ionic therapy. The device 10 is comprised of a tool part 20 having a head end 22. The head end 22 can be any of a number of preselected shapes including, but not limited to, those shown in FIGS. 4 and 4A. The tail end 24 of tool part 20 is comprised of an intermediate portion or shaft 23 which having a predetermined length which terminates in a means 26 for removable attachment to a handle part 30.

Figure 2:
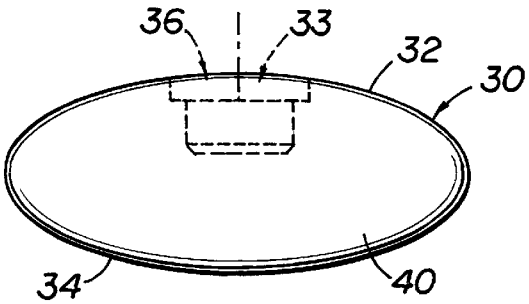
FIG. 2 shows a perspective view of an alternate shape of the handle portion of one embodiment of the invention.
Figure 3:
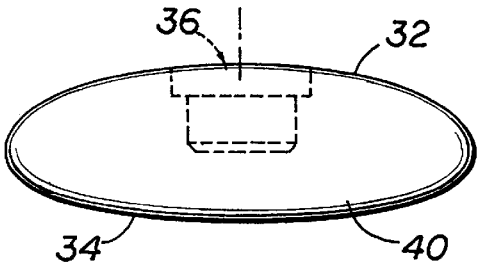
FIG. 3 shows a perspective view of an alternate shape of the handle portion of one embodiment of the invention.

In the preferred embodiment, the handle part 30 has an ergonomic, substantially oval shape of a predetermined diameter and thickness as is illustrated in FIGS. 1–3. Handle part 30 has a top surface 32 and a bottom surface 34. A means 36 for removably receiving the tail end 24 of tool part 20 is located on the top surface 32 of handle part 30. The preferred embodiment further comprises a negative ion emitting surface 40 that covers at least a portion of the tool part 20 and/or the handle part 30.

In the embodiment shown in FIG. 1, the means 26 located on tool part 20 for removable attachment to handle part 30 comprises external threads 27 on the distal end 28 of tail end 24. A collar or shoulder 25 is located at the point where threads 27 terminate nearest the head end 22 of tail end 27. The receiving means 36 on handle part 30 for removably receiving tail part 24 is comprised of bore 33 that is complimentary in size and shape to attaching means 26 of tool part 20. Bore 33 has internal threads 35 that are complimentary to threads 28 of attaching means 26.

Figure 4:
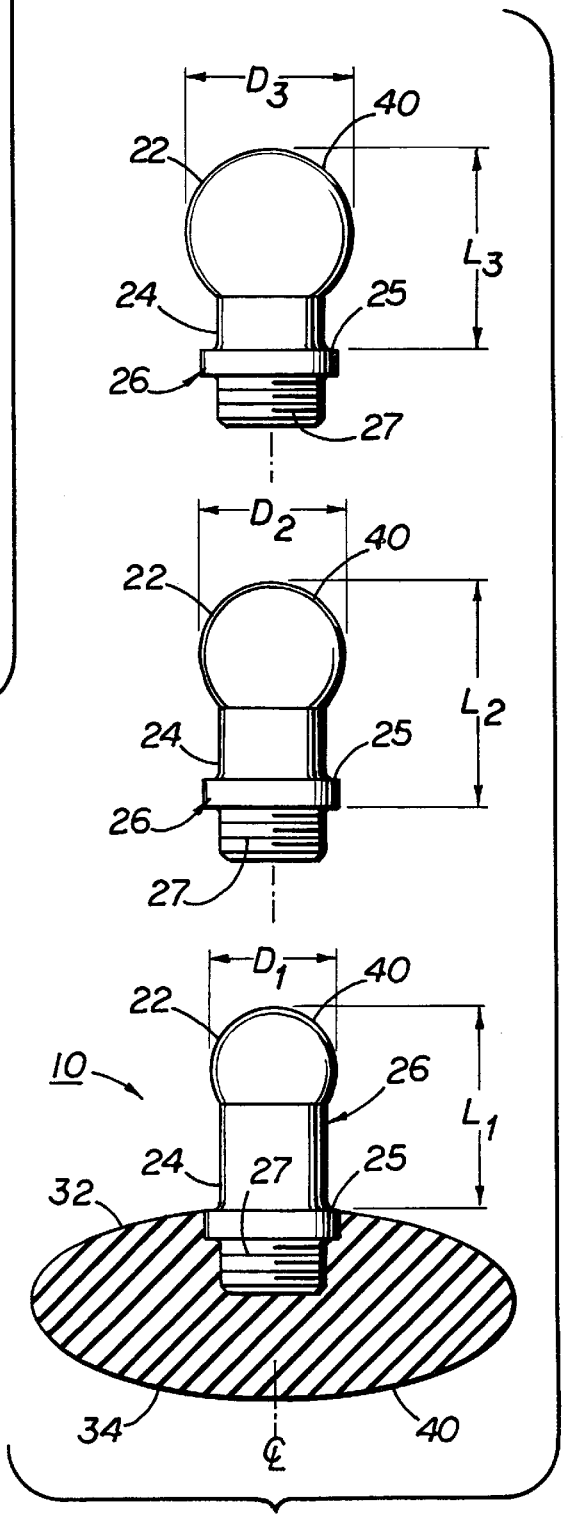
FIG. 4 shows alternate embodiments of the tooled end of the device of the invention.
Figure 5:
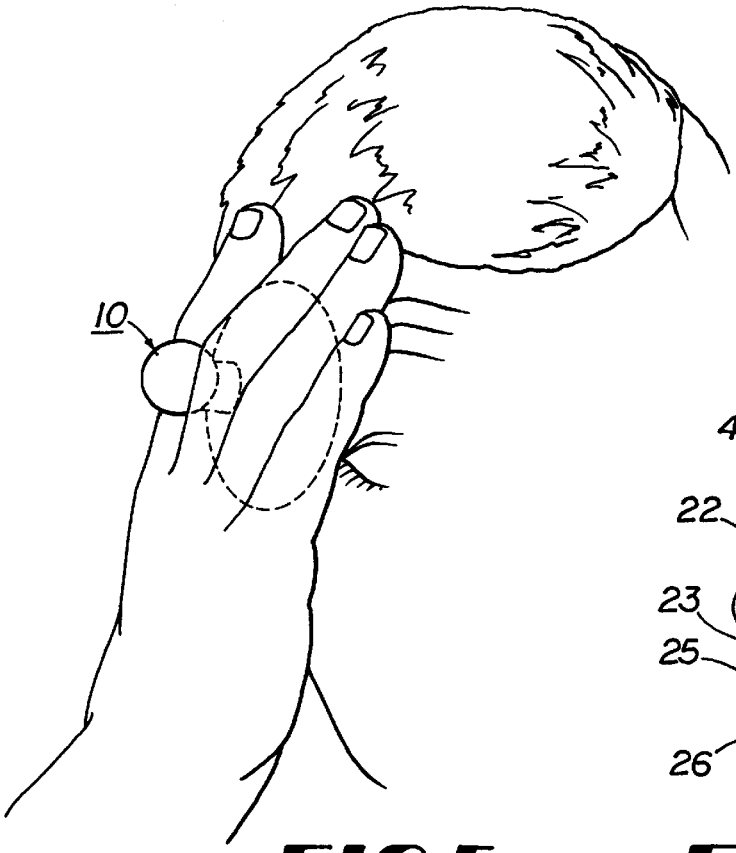
FIG. 5 shows one method for grasping the device of the invention for performing massage according to the methods of the invention.
Figure 4A:
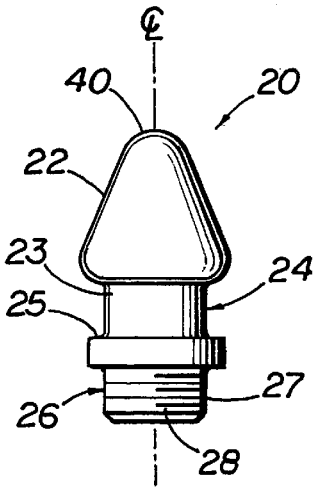
FIG. 4A shows an alternate embodiment of the tooled end of the device of the invention.
Figure 8:
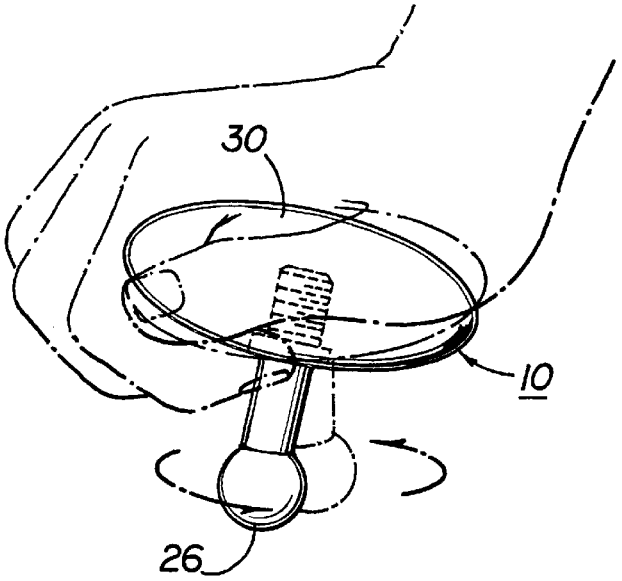
FIG. 8 shows one method for grasping the device of the invention for performing massage according to the methods of the invention.
Figure 9:
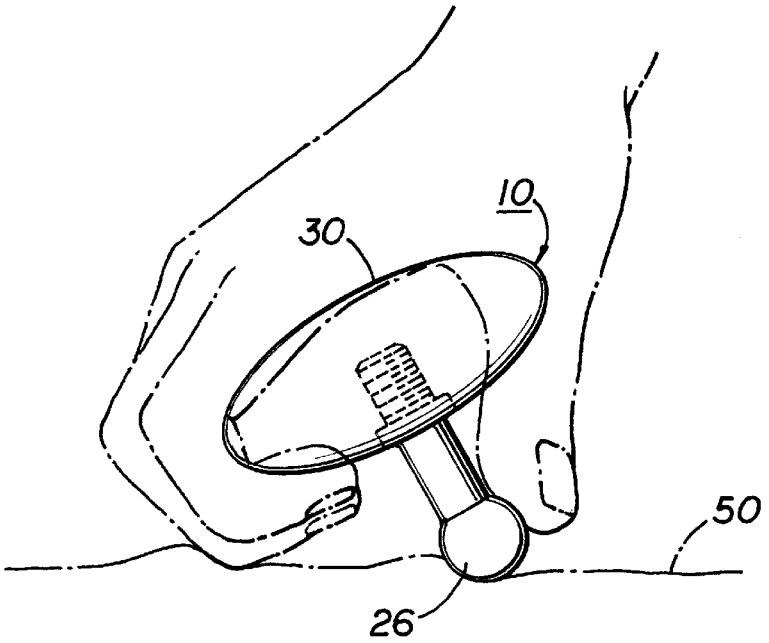
FIG. 9 shows another method for grasping the device of the invention for performing massage according to the methods of the invention.
Figure 10:
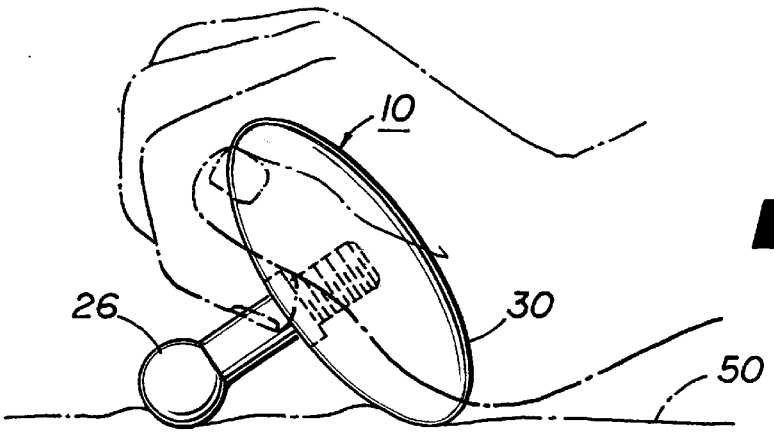
FIG. 10 shows another method for grasping the device of the invention for performing massage according to the methods of the invention.
Figure 11:
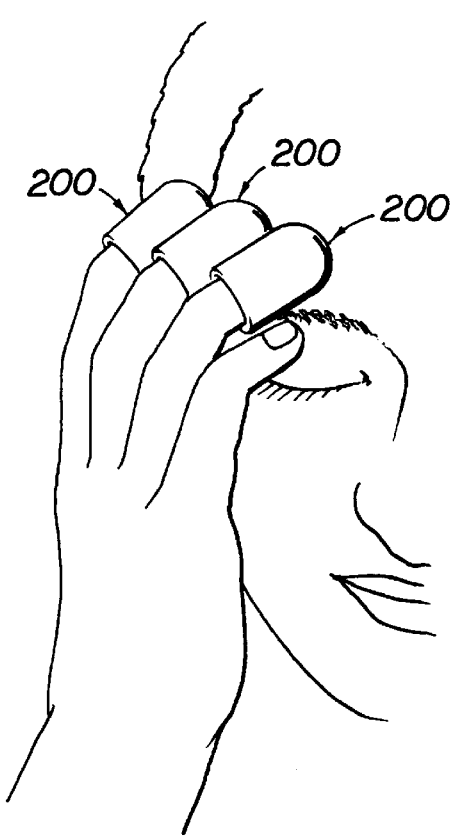
FIG. 11 shows another embodiment of the device of the invention and a method for performing massage according to the invention.
Figure 12:
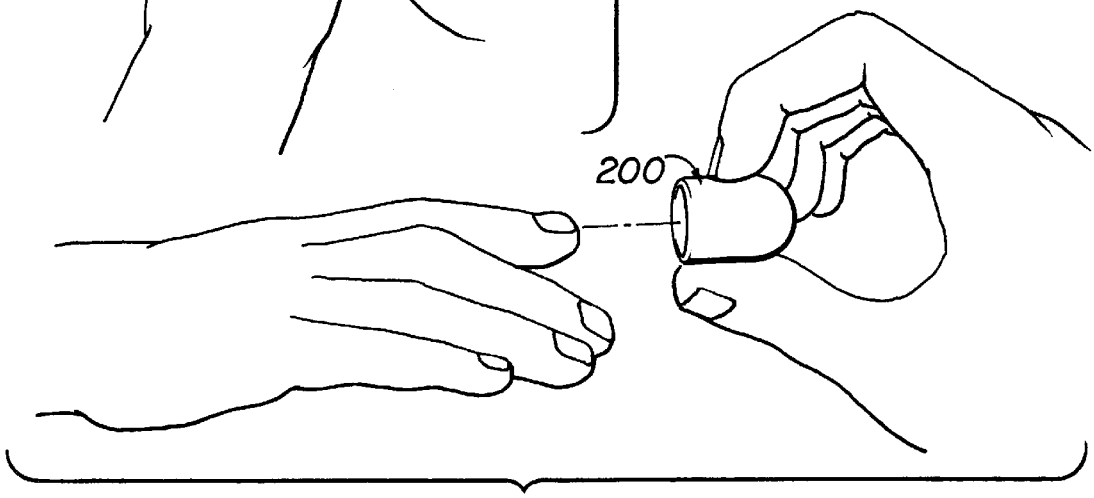
FIG. 12 shows placement of the device shown in FIG. 11 on a finger for performing massage according to the methods of the invention.
Figure 13:
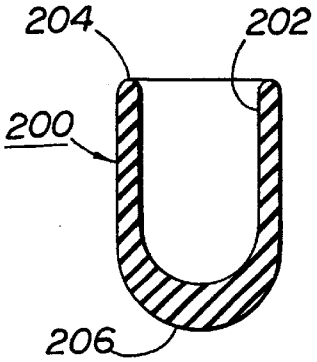
FIG. 13 shows one embodiment of the finger tip message device.
Figure 14:
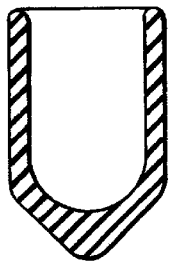
FIG. 14 shows one embodiment of the finger tip message device.

A counter sink 37 complimentary to shoulder 25 is located within bore 33 and adjacent top surface 32 of the handle part 30. In the embodiment shown in FIGS. 1–4, tool part 20 is attached to handle part 30 by screwing threads 27 of the attaching means 26 into bore 33 of handle part 30. When properly attached, as shown in FIG. 4, shoulder 25 fits snugly into counter sink 37. This a configuration gives added strength and stability to the attachment and allows more force to be exerted against the moment arm created between head end 22, intermediate shaft 23 and handle part 30 during a massage procedure (as shown in FIGS. 8–10).

It can be appreciated by one of skill in the art that the device of the invention can be constructed from a variety of suitable relatively non-absorbent materials, including but not limited to, ebonite, amber, plastics, polymers metals and the like. Wood which absorbs bodily fluids is not a suitable material for construction of devices made according to the invention unless the exposed surfaces are covered with a suitable relatively non-absorbent material as set forth above. Wood is especially less suitable for utilizing the devices made according to the invention in methods of therapy which augment lymphatic drainage. The coarse texture of wood and lack of durability renders this material unsuitable.

A preferred embodiment of the device comprises a negative ion emitting surface 40 which covers at least a portion of the tool part 20 and/or handle part 30. It is contemplated that the negative ion emitting surface 40 can cover the entire device. In one embodiment, the negative ion emitting surface covers at least a portion of the tool end 22 and handle part 30.

Figure 7:
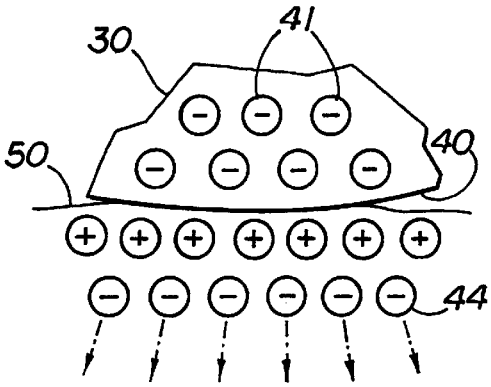
FIG. 7 is a schematic representation of negative ion penetration to deep tissue in accordance with the methods of the invention.
Figure 6:
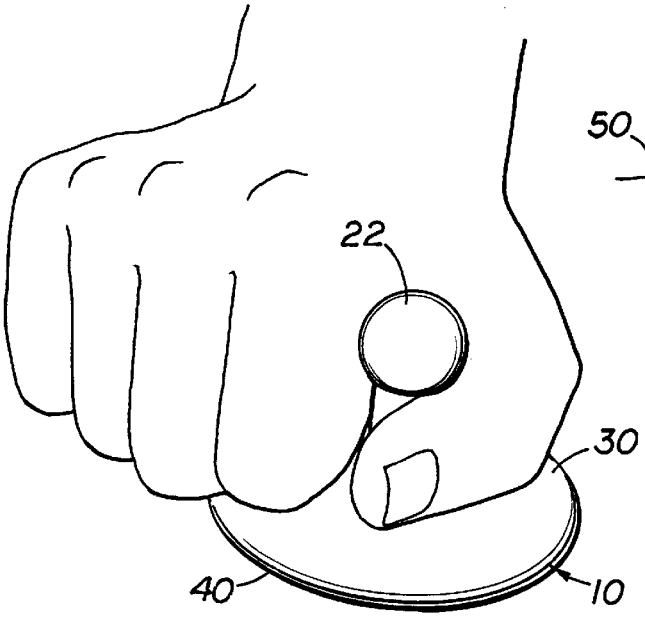
FIG. 6 shows one method for grasping the device of the invention for performing massage according to the methods of the invention.

The negative ion emitting surface can comprise any relatively non-absorbent material which emits negatively charged ions 44 in response to friction created between the negative ion emitting surface and another object, e.g., a patient's skin 50 as shown in FIG. 7. Suitable materials for the negative ion emitting surface 40 include, but are not limited to, medical ebonite, amber, a suitable plastic, a suitable polymer or the like.

The term "medical ebonite" is meant to include all forms of ebonite (also known as vulcanite or hard rubber) which have a sulphur content of greater than about 10 percent. However, it is preferable that the medical ebonite be constructed from natural rubber derived, e.g., from plants and trees such as *Hevea brasiliensis* and other species of Hevea.

In one embodiment of the invention, the negative ion emitting surface is comprised of a medical ebonite having a sulphur content of greater than about 20 percent. Yet another embodiment of the negative ion emitting surface is comprised of a medical grade ebonite having a sulphur content of greater than about 30 percent. The term vulcanized rubber is generally used to refer to hard rubber vulcanized to a rigid, but resilient solid used, e.g., for electrical parts, combs, brushes or instrument handles and the like.

Suitable polymers and plastics which can comprise portions of the device and/or the negative ion emitting surface are known to one skilled in the art of polymer and /or plastics chemistry.

The preselected shape of head end 22 of tool part 20 can vary among many shapes which are beneficial to the skilled massage therapist. Such shapes are apparent to those skilled in the art. In a preferred embodiment (as shown in FIG. 4) the preselected shape of head end 22 is substantially round having a diameter of between about 5 mm and about 30 mm. In another embodiment the preselected shape of head end 22 is substantially conical as shown FIG. 4A.

The size and length of intermediate shaft 23 will vary according to the size and shape of the head end 22 as shown in FIGS. 1–3. It is contemplated that the length of the intermediate shaft 23 can range from between about 1 mm to about 50 mm.

As the skilled artisan can appreciate, the diameter and thickness of handle part 30 can also vary according to the size and shape of tool part 20, the size of the therapist's hands and the particular application for which the device is being utilized. Generally, predetermined diameter of handle part 30 can vary from between about 45 mm and about 85 mm and the predetermined thickness is between about 15 mm and about 45 mm. In a preferred embodiment, the predetermined diameter of handle part 30 is about 65 mm and the predetermined thickness is about 22 mm.

Figure 15:
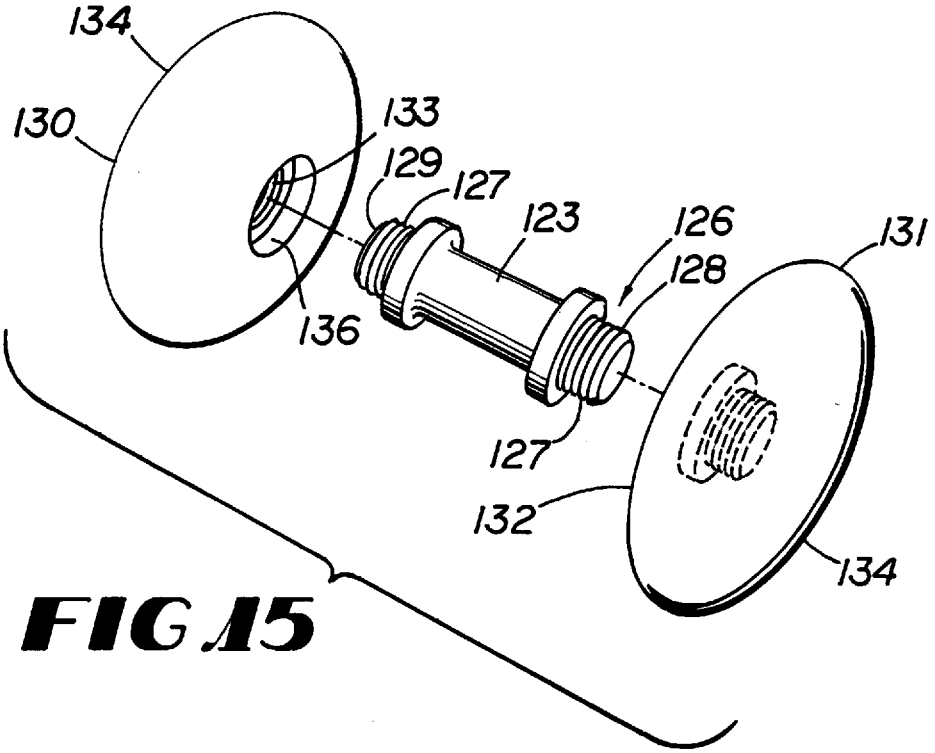
FIG. 15 is an exploded perspective view of one embodiment the invention.
Figure 16:
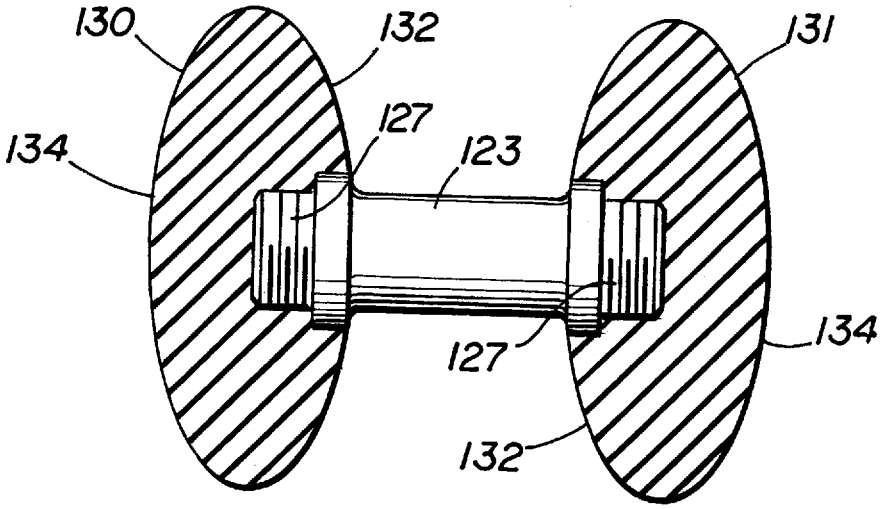
FIG. 16 is a cross-sectional view of the device shown in FIG. 15.

As shown in FIGS. 15–16, another embodiment of the invention comprises a device 100 for deep tissue massage and negative ionic therapy, comprised of first and second handle parts 130, 131. Handle parts 130, 131 are ergonomically designed for the comfort of the therapist, having a substantially oval shape of a predetermined diameter and thickness. The handle parts 130, 131 have an inner surface 132 and an outer surface 134 and means 136 adjacent each inner surface 132 for removably receiving a connecting shaft 123. The connecting shaft 123 has a preselected length, a first end 128 and a second end 129, with each end 128, 129 terminating in means 126 complimentary to the receiving means 136 for removable attachment of the first and second handle parts 130, 131. A negative ion emitting surface 140 comprises at least a portion of a selected surface of the first or second handle parts 130, 131.

In the embodiment shown in FIGS. 15–16, the attaching means 126 for removable attachment of the first and second handle parts 130, 131 comprises external threads 127 on the distal end 128 of connecting shaft 123. A collar or shoulder 125 is located at the point where threads 127 terminate. The receiving means 136 on first and second handle parts 130, 131 is comprised of bore 133 that is complimentary in size and shape to attaching means 126 of connecting shaft 123. Bore 133 has internal threads 135 that are complimentary to threads 128 of attaching means 126.

A counter sink 137 complimentary to shoulder 125 is located within bore 133 and adjacent inner surface 132 of the first and second handle parts 130, 131. First and second handle parts 130, 131 are attached to connecting shaft 123 by screwing threads 127 of the attaching means 126 into bore 133 of first and second handle parts 130, 131. When properly attached, as shown in FIG. 16, shoulder 125 fits snugly into counter sink 137. This a configuration gives added strength and stability to the attachment.

Given the teachings herein, it can be appreciated that the devices of the invention, but especially the embodiment shown in FIG. 16 having first and second handle parts, can be utilized by the professional therapist in a method of gentle massage using a decreased amount of pressure along established meridians or lymphatic pathways to facilitate lymphatic drainage of a target area and thereby promote healing or increase relaxation of tense sore muscles, especially spinal musculature. The simultaneous delivery of pressure and negative ionic therapy are accomplished without discomfort to the therapist.

FIGS. 11–14 show another embodiment of the device of the invention which is designed for insertion over the massage therapist's or patient's finger tips for giving a finger tip massage which provides negative ionic therapy. The device 200 for deep tissue massage and negative ionic therapy, comprises a substantially conically shaped member having an inner surface 202 which forms a hollow concave cavity open at a proximal end 204. The hollow concave cavity is adapted for insertion of at least a portion of a digit 250 therein. Device 200 further has an outer surface 206, at least a portion of which is comprised of a negative ion emitting material.

The present invention also provides a method of deep tissue massage and/or facilitating lymphatic drainage in combination with negative ionic therapy at a target area of a patient's body, comprising the steps of:

a. placing a hand held massage device having a negative ion emitting surface on at least a portion of the target area;

b. moving the device in a preselected direction; and c. applying a predetermined amount of pressure while moving the device in the preselected direction, thereby providing a massage to and a negative ionic therapy to the target area. The preselected direction can be virtually any direction over the body in accordance with established principals of massage therapy.

In one embodiment of the above method, prior to the placing step, the method further comprises, preparing the patient's skin by the application of a suitable lubricant to the skin of the patient at the target area. Suitable lubricants include, but are not limited to mineral oil, coconut oil, wheat germ oil, sesame seed oil, avocado oil, glycerol, glycerine, lanolin, alcohol and combinations thereof.

The skilled artisan can appreciate that, movement of the device in the preselected direction can vary depending upon the individual patient, the particular target area of the body, the disorder being treated and the particular result desired. Likewise the predetermined amount of pressure will vary depending upon the needs and sensitivity of the individual patient, the stage of therapy, the patient's response and the result desired for the condition being treated. The combined application of movement and pressure can, e.g., provide cross fiber friction for treatment of tendinitis, utilize meridians of the body for relaxation of tense muscles, facilitate lymphatic drainage of a target area or provide a segmental massage to treat disorders of the spine and/or associated musculature.

The method of the invention can utilize devices as disclosed herein and known massage principles, combining pressure and movement over the target area to facilitate massage of deeper tissues while simultaneously delivering negatively charged ions from the negative ion emitting surface.

In general, the device of the invention is rubbed against the person's skin and becomes negatively charged; the friction creates a negatively charged field on the surface of the device. This surface emits negative ions which are able to penetrate the outer layers of the skin and fat to reach deeper tissues, e.g., the network of capillaries which feed directly into the blood stream. For example, in segmental massage, this can, increase the pH level of the target cells, ionize the blood and tissues and in turn increase oxygenation and improve blood circulation while the simultaneous application of pressure massages the deeper musculature.

Devices constructed according to the present invention when utilized in the methods disclosed herein, in addition to providing the aforementioned benefits, can also raise the skin temperature as much as 3–5 degrees Centigrade which, likewise, increases circulation and promotes healing of the skin and subcutaneous tissues. The friction and negative ions emitted from the surface of the device also exert a bacteriostatic effect on the skin and promote healing or halt progression of certain infectious agents as found, e.g., in pyoderma, eczema and the like.

The methods disclosed herein can be directed to increasing lymphatic drainage at the target area and to improving lymphatic circulation. This method of therapy generally follows the regional lymph nodes and can be used in virtually every area of the human body. The skilled artisan, familiar with the appropriate anatomy can select the direction of movement and the amount of pressure depending upon the target area of lumphatics desired.

In general, the lymphatic system is closely interlinked with vascular circulation. Many lymphatic vessels lie in close proximity to larger veins. The lymphatic system is responsible for the interchange of tissue fluids and its primary concern is the removal of waste products from the body. Lymphatic fluid is carried along lymphatic vessels to lymph nodes, consisting of small solid masses of lymphoid tissues which act as a filtering system. This lymphatic filtering system is thought to work 8–10 times faster right after massage and lymphatic drainage can be facilitated by applying pressure and motion over lymph vessels utilizing the devices disclosed herein.

Lymph nodes are concentrated in certain areas or regions of the body forming in bead like clusters. When inflamed these nodes can become swollen, almond shaped and present elevations in the skin. These regional, swollen nodes can include the submandibular, beneath the mandible; the occipital, at the base of the skull; the axillary, beneath the armpit; the supratrochled at the elbow; the inguinal, in the groin; and the popliteal, behind the knee.

In one embodiment of the invention, the methods disclosed herein facilitate drainage of these superficial regional lymph nodes. Correctly applied massage with the devices disclosed herein directly and safely hastens the local removal of lymphatic fluid and delivers negatively charged ions which increase the circulation in general area.

An example of the correct procedure is to begin with a regional massage of the shoulders, followed by the back, buttocks and then the back once again. The therapist then moves to the right leg, followed by the right thigh, the right lower leg and foot. Then, he/she massages the left leg, the left thigh, the left lower leg and foot, the left arm, the chest the right arm and chest.

This routine can be altered in may ways. All of them correct and successful as long as the client is not moved or turned unnecessarily and the work is completed with the greatest efficiency and minimum discomfort to the patient and therapist.

The methods of the invention can be carried out as shown in FIGS. 5–10 wherein the device 10 is held in the hand of the therapist and moved over the skin 50 while applying a predetermined amount of pressure in a preselected direction. The skilled artism will appreciate that the direction and amount of pressure will vary with each region of the body and will vary from patient to patient. If facilitation of lymphatic drainage is desired, e.g., flowing strokes towards the nearest lymph node are utilized to facilitate drainage and, enough pressure is applied to relax tense musculature without causing undue discomfort to the patient. The skilled artism can determine the correct amount of pressure based upon individual patient response.

A routine of repeated strokes can be used to provide a good base for the massage. The devices disclosed herein can also be used based on a combination of deep muscle tissue massage and lymphatic drainage massage wherein slightly more pressure is utilized to fully reach deep within the body of larger muscles.

Flowing strokes towards the nearest lymphatic node are utilized to produce lymphatic drainage. This form of massage hastens removal of waste products from the affected the area. To avoid discomfort during the massage, the pattern of strokes should overlap slightly. Care should be taken to avoid passing over any one area repeatedly or bruising may result. Adjacent areas should be treated alternately, keeping the device moving in a rhythmical backwards and forwards motion. FIGS. 5–10 show some of the different ways of holding the device. When performing a massage it is important to remember that the position of the lymphatic nodes and lymphatic vessels act as guide lines when treating any area of the body. Strokes used should always move in a substantially straight line towards the lymphatic nodes.

In other embodiment, a back massage for example, once the patient is comfortably settled and warm, massage can commence on the one side back with long sweeping fluid movements. The movements should be full, strong and rhythmical. They should be calmly applied preparing the client for deep circular movements using the device as an extension of the therapist's hand. However, care must be taken not to rub hard against bones, particularly the spine or the scapula. This procedure is then repeated on the opposite side of the back. If needed, deep kneading my be applied over the entire surface to the back working up and down, avoiding the spine and starting in the cervical region concluding at the sacrum. Deep kneading can also be applied over the scapular area by carefully reinforcing and supporting the hand holding the device with the opposite hand.

Alternatively, a segmental massage of the back can also be given utilizing the devices disclosed herein. Thirty one pairs of spinal nerves branch out from the vertebra to the right and left sides of the body. Each pair of nerves supplies a particular area of the body which is identified by the section of the vertebra from where it leaves the spinal cord. The skilled antism will know the anatomy, and can apply segmental massage which targets distribution of these spinal nerves and thereby target particular segments of the body.

Isolated muscles can also benefit from the devices and methods disclosed herein. For example, deep kneading can be applied in trapezius muscle area. To accomplish this movement on both sides of the trapezius, it is necessary to turn the head. The method uses effleurage to link the movements and re-establish relaxation. In between the kneading strokes, the therapist can use more penetrating strokes by applying increased pressure. Use of the opposite hand for support of the muscles can be used to prevent any discomfort from occurring. On the larger, more resilient areas such as the hips and thighs, deep effective vibratory movements can be applied. Use of the supporting hand method can also act as a bolster, pushing the muscles towards the device as pressure and movement are applied.

After massage and ionic delivery, the patient feels very relaxed and notices substantial warmth in their muscles. The ergonomic design of the device and smooth surfaces of the ion emitting surface, e.g., a polished medical ebonite or amber surface, feel so natural, that it is virtually impossible for the patient to distinguish between the human hand alone and the hand in combination with the devices disclosed herein.

The embodiment shown in FIGS. 11–14 can also be utilized in a method of massage or facilitation of lymphatic drainage in combination with negative ionic therapy. The device 200 is placed on the finger tip and the fingers instead of the hand are used to apply the pressure and movement of the device. Pinpoint or segmental massage, especially in delicate areas such as the face or scalp is especially effective.

In general, all treatments are more effective when a fine massage oil is used. One skilled in the art can appreciate that many different oils, lotions or "massage preparations" can be used. One example of a massage lotion that is especially suitable for preparation of the patient's skin is that manufactured by Judith Suns, Inc., Atlanta, Ga., 30340.

Throughout this application various publications are referenced. The disclosures of these publications in their entireties are hereby incorporated by reference into this application in order to more fully describe the state of the art to which the invention pertains.

What is claimed is:

1. A kit for tissue massage and negative ionic therapy, comprising a first tool part, a second tool part and a handle part; said first tool part comprising a head end of a first preselected shape and having a first negative ion emitting surface thereon, and a tail end projecting a predetermined distance from the head end and comprising removable attachment means for engaging the handle part; said second tool part comprising a head end of a second preselected shape and having a second negative ion emitting surface thereon, and a tail end projecting a predetermined distance from the head end and comprising removable attachment means for engaging said handle part; and said handle part comprising means for interchangeably receiving the removable attachment means of a selected one of said first and second tool parts; wherein the first and second negative ion emitting surfaces are comprised of ebonite.

* * * * *